US006490739B1

(12) United States Patent
Lee

(10) Patent No.: US 6,490,739 B1
(45) Date of Patent: Dec. 10, 2002

(54) PLUG FOR A SINK DRAIN

(75) Inventor: Leon Lee, Taipei (TW)

(73) Assignee: Princeton International Company, Taipei (TW)

( * ) Notice: Subject to any disclaimer, the term of this patent is extended or adjusted under 35 U.S.C. 154(b) by 0 days.

(21) Appl. No.: 10/013,022

(22) Filed: Dec. 7, 2001

(51) Int. Cl.[7] ..... A47K 1/14
(52) U.S. Cl. ..... 4/293; 4/668
(58) Field of Search ..... 4/286, 287, 293, 4/295, 688

(56) References Cited

U.S. PATENT DOCUMENTS 4,720,877 A * 1/1988 Watts ..... 4/286
4,926,507 A * 5/1990 Craig et al. ..... 4/295
5,832,545 A * 11/1998 Pan ..... 4/293
5,881,397 A * 3/1999 Hobbs ..... 4/287

* cited by examiner

*Primary Examiner*—Charles E. Phillips
(74) *Attorney, Agent, or Firm*—Thomas, Kayden, Horstemeyer & Risley, LLP

(57) ABSTRACT

A plug for a sink drain includes a body fitted to a sink, a connector with a spring and secured to the body, a cap mounted on the connector, and a knob mounted on the cap. The spring extends through the connector to urge against the cap whereby the plug has a raised mode in which water can drain from the sink and a lowered mode in which water is retained in the sink.

1 Claim, 5 Drawing Sheets

PLUG FOR A SINK DRAIN

BACKGROUND OF THE INVENTION

1. Field of the Invention

The present invention relates to a plug for a sink drain, and more particularly a drain for a sink drain that is easily manufactured.

2. Description of Related Art

Sinks for various purposes need a plug to keep the water therein until the washing process is completed whereafter the water can be easily drained away by releasing engagement between the sink and the plug. One problem of plugs is that they can be lost or even stolen from a public washroom, and this renders the sink almost useless as no water can be kept in the sink. To overcome such a problem, plugs with a sprung-loaded rod securely extended into a drain pipe of the sink are used, but it is still found that shortcomings exist in the secured plug. For example, FIGS. 4 and 5 show a prior art plug for a sink drain comprising a hollow body, a connector (50), a cap (60), and a hollow knob (70). The body has a top ingress and a bottom egress. A brace extends across the egress and a screw hole is defined in the brace. The cap (60) has tube portion (62) and a flanged portion (64) extending from a top of the tube (62). A bore (622) is defined down the tube (62), a counter bore (642) is defined in the flanged portion (64) and a mouth (644) is defined at a bottom of the bore (622). The counter bore (642) has a screw thread (644) leading to the bore (622). The knob (70) has a bottom opening (72) leading to a recess (74), and a male thread (76) formed around a bottom of the knob (70) whereby the knob (70) can be threadedly engaged with the screw thread (644) of the cap (60). The connector (50) includes a rod (52) with a large head (54) formed at the top and a screw (56) formed at the bottom. The large head (54) is sized to be enter the recess (74) of the knob (70) and the screw (56) mates with the screw hole of the body. A cutout (58) is formed on a side of the rod (50) and includes a partition (582) defining two platforms (584), and a slit (586) defined along a side edge of the platforms (584). A spring (53) shaped substantially as an inverted T has a top end (532) mounted on a top of the partition (582), two sides extending down the partition, and two hooks (534) moveably received in the slit (586) and diametrically protruding from the connector (50). A distance across the hooks (534) when the spring (53) is in a released status is smaller than the diameter of the mouth but greater than the diameter of the bore (622). In assembly, the rod (50) is inserted in the cap (60) via the counter bore (642) such that the screw (56) protrudes from the mouth (644) of the cap (60), whereafter the male thread (76) of the knob (70) is mated with the female thread (644) of the counter bore (642) of the cap (60). Then, the combined connector (50), cap (60) and knob (70) are entered into the hollow body such that the screw (56) of the connector (50) mates with the screw hole of the brace of the body which is secured to a sink drain. By pulling the knob (70) upward, the cap (60) is accordingly lifted away from the body until the large head (54) of the connector (50) abuts a wall defining a bottom of the counter bore (642) of the cap (60), whereby a gap is defined between the flange (64) of the cap (60) and the body to allow water to flow into the sink drain. The hooks (534) of the spring (53) abut a shoulder between the bore (622) and mouth (644) of the cap (60) such that the cap (60) can remain in this opened position without need for a user to stand there until all the water has drained away. In a reversal of that process, the knob (70) is pushed downward until the flange (64) of the cap (60) covers the ingress of the body and the hooks (534) of the spring (53) urge against a wall defining the bore (622) of the cap (60) whereby the cap (60) is held in place to ensure retention of the water in the sink. It is to be noted that one or more gaskets are commonly used but not mentioned here. However, although the prior art plug is very effective in function it is found that the manufacture of the connector is particularly troublesome and expensive. That is, the casting of the connector to include the partition and the slit is too difficult to be commercially viable. The slit must be a very exact size and shape to allow the spring to be received and retained satisfactorily therein, but it is found that inevitable fluctuations in casting result in difficulties for assemblers to fit the spring to the connector. Thus, time is lost in assembly of the prior art plug, as well as excessive costs being incurred through reject quality connectors having to be scrapped. Furthermore, if the spring should become dislodged from the connector it will be flushed down the drain and a complete new plug mechanism will need to be bought and fitted. Even if the dislodged spring still hangs on the connector, refitting the spring is beyond the skill of the lay person and again a new plug mechanism will need to be purchased. Thus, there is a need for a plug for a sink drain with a connector that is effective yet inexpensive and convenient to manufacture and maintain.

Therefore, it is an objective of the invention to provide a plug for sink drain to mitigate and/or obviate the aforementioned problem.

SUMMARY OF THE INVENTION

The object of the present invention is to provide a plug for a sink drain wherein a connector thereof is manufactured easily and at low cost.

Other objects, advantages and novel features of the invention will become more apparent from the following detailed description when taken in conjunction with the accompanying drawings.

DETAILED DESCRIPTION OF THE PREFERRED EMBODIMENT

Figure 1:
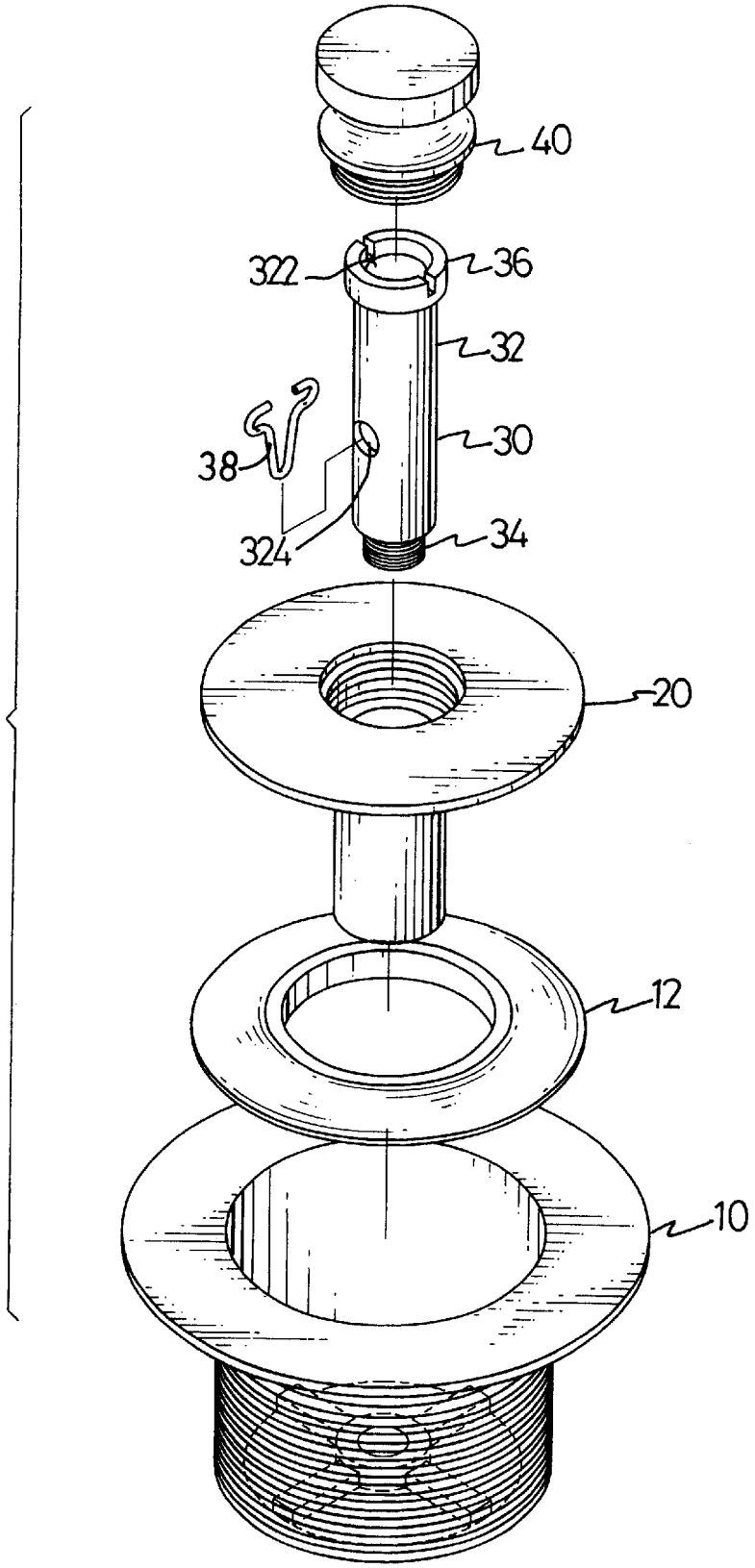
FIG. 1 is an exploded view of a preferred embodiment of a plug for a sink drain in accordance with the present invention.
Figure 6:
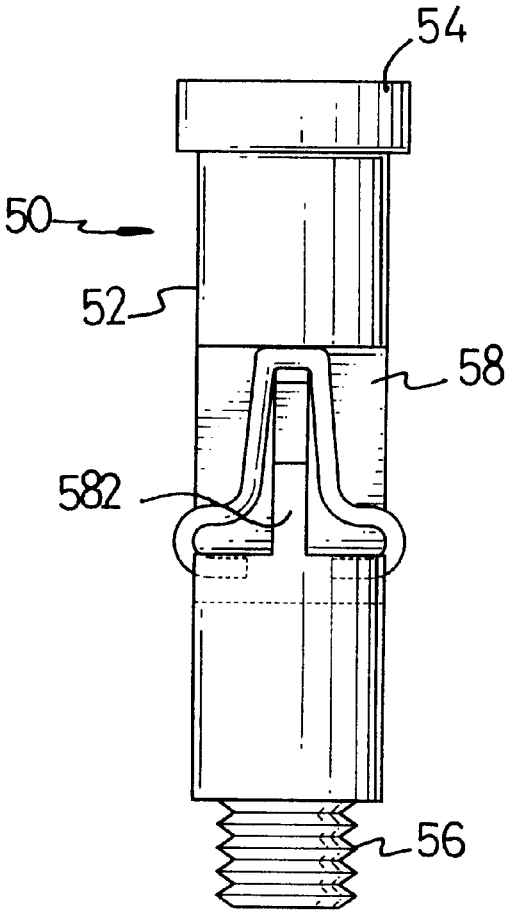
FIG. 6 PRIOR ART
FIG. 6 is a side view of a core rod of the prior art plug of FIG. 5.
Figure 2:
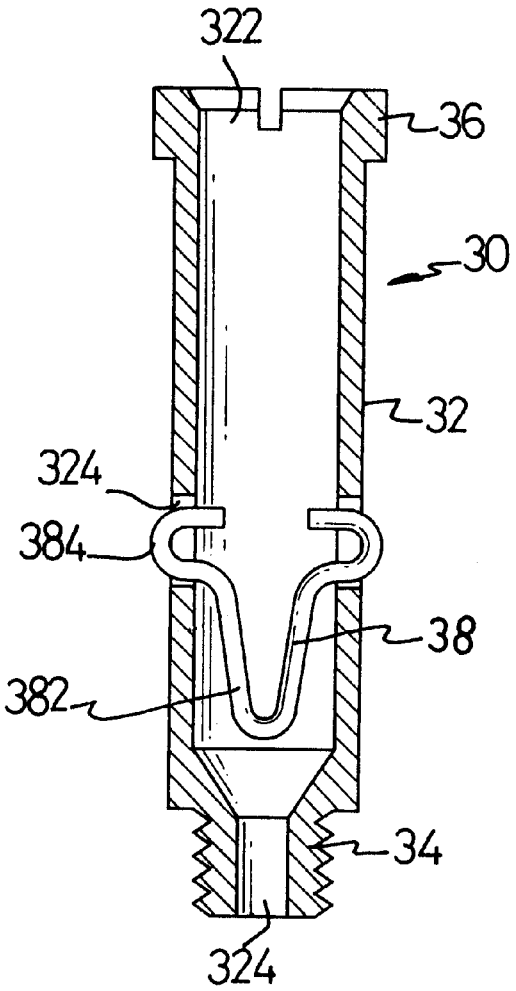
FIG. 2 is a cross-sectional view of a core rod of the plug shown in FIG. 1.

Referring to FIGS. 1 and 2, a plug for a sink drain in accordance with the present invention includes a hollow body (10), a washer (12), a cap (20), a connector (30) with a spring 38), and a knob (40).

The body has an ingress at a top end, and an egress at a bottom end with a passage extending between the ingress and egress. A brace is formed at the egress and defines a screw hole in the center thereof. However, as the body is conventional in form and function and known to those skilled in the art, further description thereof is omitted.

The connector (30) comprises a tube (32), a screw (34) formed at a bottom of the tube (32), and a head (36) formed at a top of the tube (32). A bore (322) of the tube (32) terminates in a counter sunk orifice (324) at a bottom thereof and has a counter sink defined at a top thereof. A transverse passage (324) is defined through the tube (32) to communicate with the bore (322). The spring (38) has a V-shaped lower portion (382) and two ears (384) extending laterally and respectively from tips of the V-shaped portion (382). The ears (384) are configured to extend through and resiliently protrude from the passage (324) when the spring (38) is fitted in the bore (322) of the connector (30).

The cap (20) includes a hollow rod (22) defining a lumen (222), and a plate (24) formed at a top end of the rod (22). A mouth (224) is defined at a bottom of the lumen (222) and has a diameter larger than a diameter of the lumen (222) whereby a lower shoulder (226) is formed between the lumen (222) and the mouth (224). A recess (242) is defined in a top of the plate (24) and communicates with the lumen (222). The plate (24) includes a flange (244) with a diameter greater than a diameter of the ingress of the body, and an annular undercut (246) defined below the flange (244). The undercut (246) receives a gasket. The recess (242) has a diameter greater than the diameter of the lumen (222) whereby an upper shoulder (248) is formed between the recess (242) and the lumen (222). A female thread (247) is formed in the recess (242). An upper portion of the lumen (222) tapers outward slightly to the recess (242).

The knob (40) has a bottom opening (42) leading to a void (44), and a wall defining the opening (42) has a male thread (46) formed thereon. The opening (42) and void (44) are sized to receive the head (36) of the connector (30).

In assembly, the spring (38) is fed V-shaped portion (382) first into the bore (322) of the connector (30) via the counter sink and pushed downward until the ears (384) spring out through the passage (324). Then the connector (30) is fed screw (34) first into the recess (242) and lumen (222) of the cap (20) until the head (36) of the connector (30) abuts the upper shoulder (248) of the cap (20). Next, the male thread (46) of the knob (40) is mated with the female thread (247) of the cap (20) such that the head (36) of the connector (30) is received in the void (44) of the knob (40). Then the screw (34) of the connector (30) is mated with the screw hole of the brace.

Figure 3:
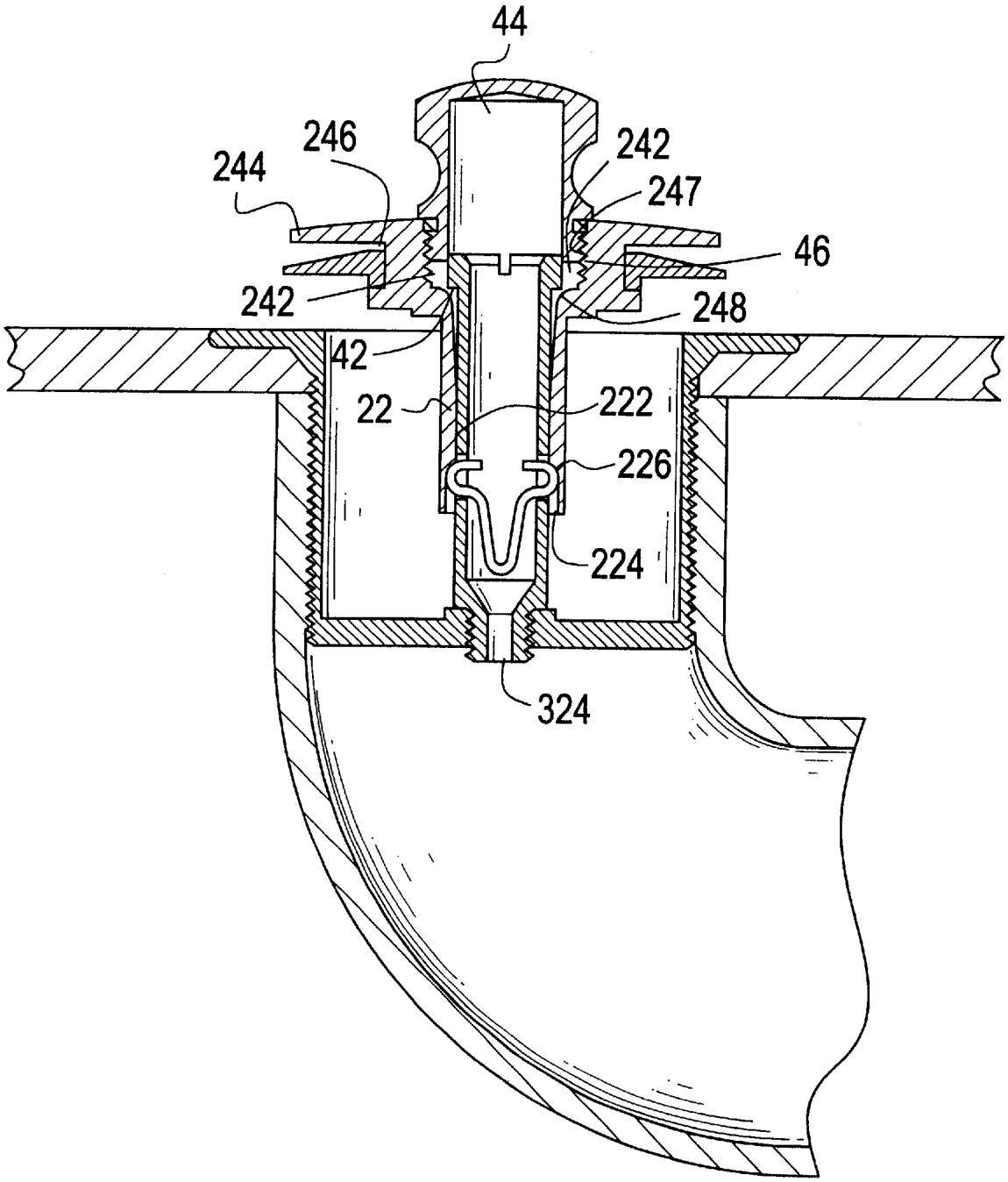
FIG. 3 is a cross-sectional view of the plug shown in FIG. 1 and in a raised position in a drain sink.
Figure 4:
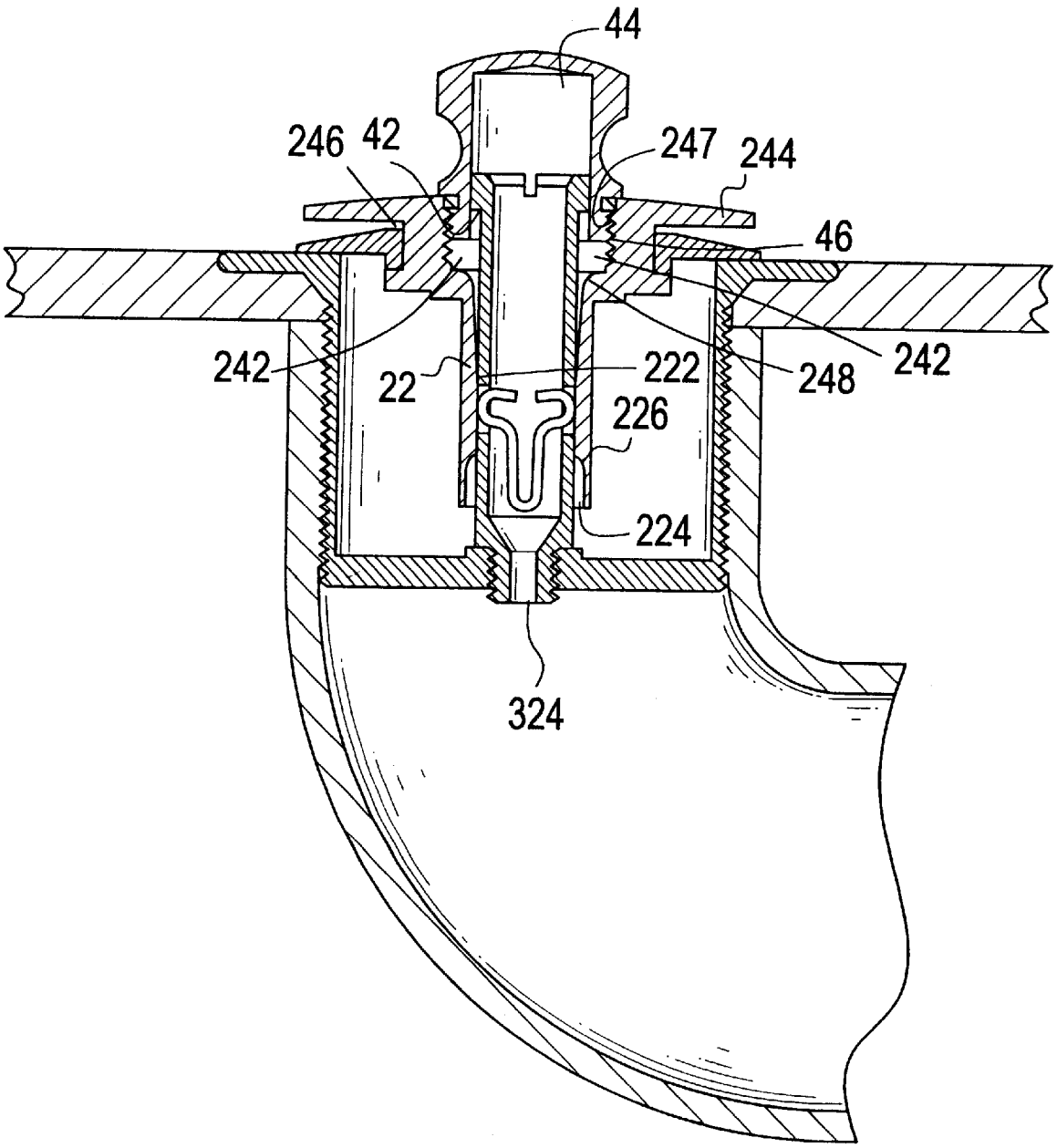
FIG. 4 is a cross-sectional view of the plug shown in FIG. 1 and in a lowered position in the sink drain.
Figure 5:
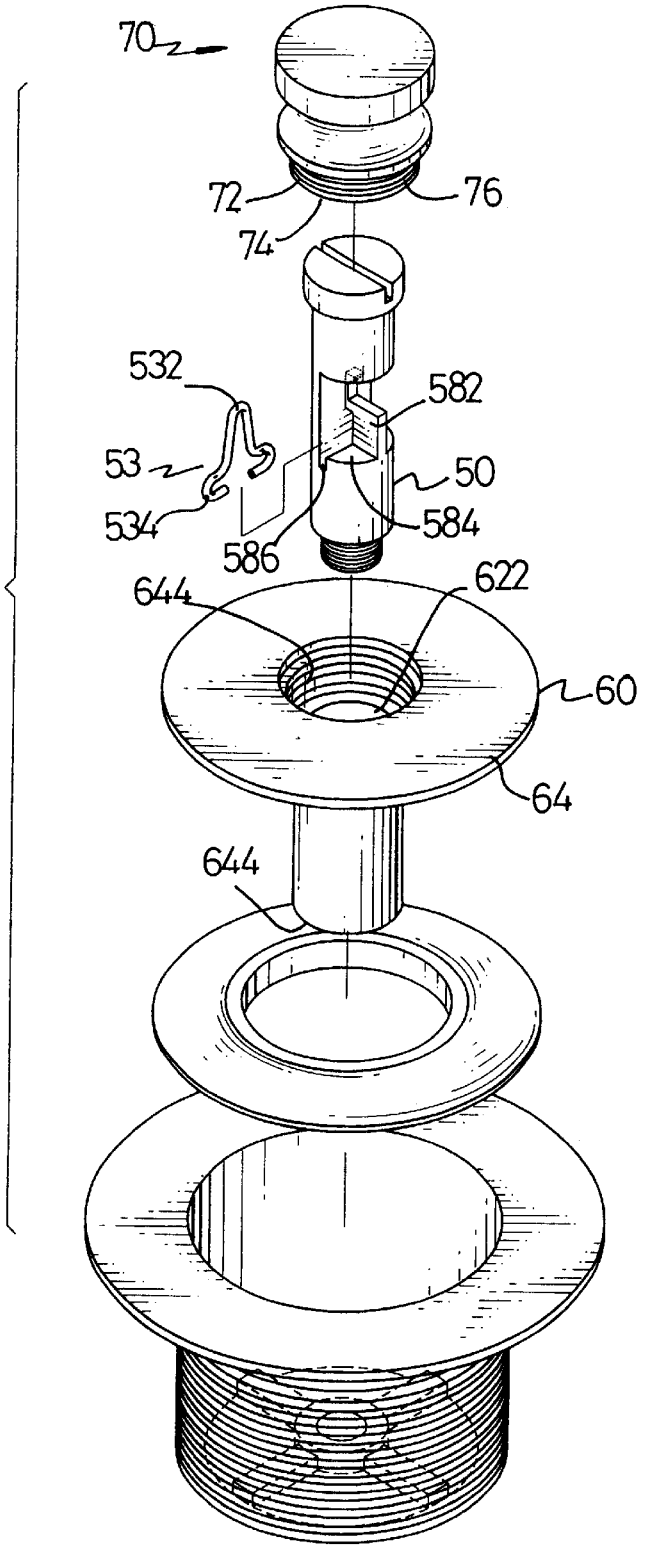
FIG. 5 PRIOR ART
FIG. 5 is an exploded view of the a prior art plug for a sink drain.

In operation, referring to FIG. 3, in a raised mode whereby water can flow from a sink to a drain, the knob (40) has been pulled away from the body such that the ears (384) of the spring (38) abut the lower shoulder (226) of the cap (20) whereby the assembled cap (20) and knob (40) are supported by the spring (38). In a lowered mode as seen in FIG. 4, wherein the ingress of the body is blocked by the flange (244) and the gasket, the knob (40) has been pushed down towards the body and the ears (384) have been pushed towards each other by the wall defining the lumen (222). Tension of the compressed spring (38) urges the ears (384) against the wall defining the lumen (222) whereby the combined cap (20) and knob (40) are retained in this mode until it is necessary to again raise the plug.

The plug for a sink drain has the following advantages:

1. ease of manufacture. The bore of the connector can be easily manufactured by casting or machining, and is far simpler than the precision casting required in the connector of the prior art.
2. ease of assembly. Insertion of the spring into the bore of the connector is a simple operation that can be carried out with a minimum of skill and does not require any special tools.
3. low cost. The ease of manufacture and assembly result in an inexpensive connector.
4. ease of maintenance. If, after long term use it should be necessary to re-engage the spring this can be easily done by a lay person.
5. safety. The orifice is much smaller than the distance across the ears such that the spring cannot be lost even in the unlikely event of the spring becoming disengaged from the passage of the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug for a sink drain, said plug having a body with a screw hole fitted to a sink and adapted to receive a plugging element comprising:

a connector in the form of a tube, a head formed at a top of the tube, and a screw formed at a bottom of the tube and mating with the screw hole of the body, a bore defined in the tube, an orifice defined at a bottom of the bore and having a diameter smaller than a diameter of the bore, and a transverse passage defined in the tube and in communication with the bore;

a spring having a V-shaped lower portion with two upper tips and two ears extending outwardly and respectively from the upper tips, the spring being configured to be received in the bore of the connector such that the ears extend through and protrude from the passage;

a cap having a hollow rod defining a lumen and a mouth at a bottom of the lumen and having a diameter larger than a diameter of the lumen whereby a shoulder is formed between the lumen and the mouth, and a plate portion with a flange and a threaded recess formed in a top face of the plate portion and in communication with the lumen whereby an upper shoulder is formed between the lumen and the threaded recess; and a hollow knob with an opening defined in a bottom thereof and the opening leading to a void configured to receive therein the head of the connector, and a male thread sized to mate with the threaded recess of the cap, wherein, in a lowered mode of the plug the ears of the spring urge against an inner surface defining the lumen and in a raised mode of the plug the ears of the spring support the lower shoulder of the cap.

* * * * *